US007407244B2

(12) United States Patent
Mitsuki et al.

(10) Patent No.: US 7,407,244 B2
(45) Date of Patent: Aug. 5, 2008

(54) PRINTING METHOD AND PRINTING APPARATUS

(75) Inventors: Kiyoomi Mitsuki, Kyoto (JP); Seiji Mochizuki, Nagano (JP); Masahiro Nakamura, Nagano (JP); Nobutoshi Otsuka, Nagano (JP)

(73) Assignees: Dainippon Screen Mfg. Co., Ltd., Kyoto (JP); Seiko Epson Corporation, Nagano (JP)

( * ) Notice: Subject to any disclaimer, the term of this patent is extended or adjusted under 35 U.S.C. 154(b) by 153 days.

(21) Appl. No.: 11/514,174

(22) Filed: Sep. 1, 2006

(65) Prior Publication Data

US 2007/0052744 A1 Mar. 8, 2007

(30) Foreign Application Priority Data

Sep. 5, 2005 (JP) ..... P2005-255980

(51) Int. Cl.
*B41J 29/38* (2006.01)

(52) U.S. Cl. ..... 347/12; 347/10

(58) Field of Classification Search ..... 347/9, 347/10, 11, 12, 15, 19
See application file for complete search history.

(56) References Cited

U.S. PATENT DOCUMENTS 6,386,665 B2 * 5/2002 Takahashi et al. ..... 347/10
6,712,445 B2 * 3/2004 Yonekubo ..... 347/19
6,764,153 B2 * 7/2004 Tanaka ..... 347/10
2005/0088469 A1 4/2005 Igarashi

FOREIGN PATENT DOCUMENTS

JP 2001-191591 A 7/2001
JP 2003-266651 A 9/2003

* cited by examiner

*Primary Examiner*—Lamson D. Nguyen
(74) *Attorney, Agent, or Firm*—McDermott Will & Emery LLP

(57) ABSTRACT

A timing signal generator generates an ejection timing signal each time a printing paper travels a predetermined distance relative to a head, and a driving signal generator inputs a driving signal based on writing data to the head each time an ejection timing signal is generated. In the course of printing, when an interval between two continuous ejection timing signals is equal to or longer than twice a basic time period of input of driving signal which is fixed for a head, a non-ejection driving signal which is a driving signal indicating a non-ejecting operation is input to the head between two driving signals respectively associated the two continuous ejection timing signals. Accordingly, it is possible to reliably and properly perform ejection of ink based on writing data with a time period equal to or longer than the basic time period.

18 Claims, 10 Drawing Sheets

PRINTING METHOD AND PRINTING APPARATUS

BACKGROUND OF THE INVENTION

1. Field of the Invention

The present invention relates to techniques for printing using an inkjet head.

2. Description of the Background Art

Conventionally, a printing apparatus which includes a head with a plurality of outlets and controls ejection of a fine droplet (which will hereinafter be simply referred to as a "droplet") of ink from each of the plurality of outlets while scanning the head relative to a printing paper, has been employed. Also, as one modification of the above-noted printing apparatus, an apparatus of a type that includes a plurality of heads which are placed to cause numerous outlets to be arranged in a direction perpendicular to a scanning direction in a range corresponding to a width of a printing paper (in other words, includes full-line heads), is known. The apparatus of the foregoing type can perform a printing process at a high speed through one scanning operation on a printing paper using the heads (in other words, in one pass).

Japanese Patent Application Laid-Open No. 2003-266651 (which will hereinafter be referred to as "Reference 1") discloses that when a travel speed of a head is lower than a reference speed, a droplet of ink is ejected at a time behind a time when a droplet of ink is supposed to be ejected if the head moves at the reference speed, to thereby accomplish printing with high accuracy. On the other hand, according to Japanese Patent Application Laid-Open No. 2001-191591 (which will hereinafter be referred to as "Reference 2"), one of plural print speeds is selected and set by monitoring an amount of writing data which is input from the outside and stored in a print buffer, to thereby accomplish printing at an optimal print speed which is suitable to an amount of writing data stored in the print buffer.

In the meantime, an inkjet head performs an operation related to ejection of droplets of ink from a plurality of outlets in response to input of a driving signal generated based on writing data. In this regard, a basic time period with which the driving signal is input (or a driving frequency) is fixed as a rated value of the head, typically. Then, the head ejects droplets or performs a non-ejecting operation (operation when ejection of droplets is not performed) such as an oscillatory motion which is so slight that a droplet cannot be ejected from each outlet, with a basic time period. In this manner, the head properly and reliably achieves ejection of ink from the outlets while keeping a state of the vicinity of each outlet of the head substantially unchanged. However, in a printing apparatus including the foregoing head, when a printing process is performed with a travel speed of the head relative to a printing paper being reduced to be lower than a steady speed determined in accordance with a basic time period as in References 1 and 2, an operation related to ejection of droplets from the outlets is repeated with a longer time period than the basic time period. As a result, the state of the vicinity of each outlet of the head is changed or somewhat affected, to fail to reliably and properly eject ink in some cases.

SUMMARY OF THE INVENTION

The present invention is directed to a printing method using an inkjet head, and it is an object of the present invention to reliably and properly perform ejection of ink based on writing data with a time period longer than a basic time period which is previously fixed for the head.

The printing method includes the steps of: a) causing a printing medium to move in a predetermined direction of movement relative to a head which ejects droplets of ink from a plurality of outlets toward the printing medium; b) generating an ejection timing signal each time the printing medium travels a predetermined distance relative to the head, concurrently with the step a); c) inputting a driving signal for an operation related to ejection of droplets from the plurality of outlets based on writing data, to the head each time the ejection timing signal is generated; and d) inputting at least one non-ejection driving signal, each of which is a driving signal indicating a non-ejecting operation, to the head between driving signals respectively associated with one ejection timing signal and a next ejection timing signal generated subsequently to the one ejection timing signal in a case where an ejection interval which is a time period between generation of the one ejection timing signal and generation of the next ejection timing signal in the step b) is equal to or longer than twice a basic time period of input of driving signal which is fixed for the head. According to the present invention, it is possible to reliably and properly perform ejection of ink based on writing data with a time period which is equal to or longer than twice a basic time period of input of a driving signal which is fixed for the head.

According to one preferred embodiment of the present invention, the number of the at least one non-ejection driving signal is determined on the basis of a preceding ejection interval which precedes by a predetermined number of intervals to the ejection interval between the one ejection timing signal and the next ejection timing signal. More preferably, a value is obtained by subtracting a predetermined extremely short time shorter than the basic time period from the preceding ejection interval, and the number of the at least one non-ejection driving signal is obtained by subtracting one from a quotient resulting from division of the value by the basic time period. As a result, it is possible to easily estimate an ejection interval and easily determine the number of non-ejection driving signals.

According to one aspect of the present invention, a travel speed of the printing medium relative to the head is temporarily reduced to be lower than a steady speed where the ejection timing signal is generated with the basic time period in the step a). According to another aspect of the present invention, a travel speed of the printing medium relative to the head is reduced in accordance with a transfer speed at which the writing data is transferred to a driving signal generator for generating the driving signal, to be lower than a steady speed where the ejection timing signal is generated with the basic time period, in a case where the transfer speed is lower than an input speed of driving signal which is input to the head with the basic time period. According to another different aspect of the present invention, the step b) to the step d) are performed at least either immediately after the printing medium stars to move relative to the head or immediately before the printing medium stops moving. Also in the foregoing cases, it is possible to reliably accomplish highly accurate printing.

The present invention is also directed to an inkjet printing apparatus.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
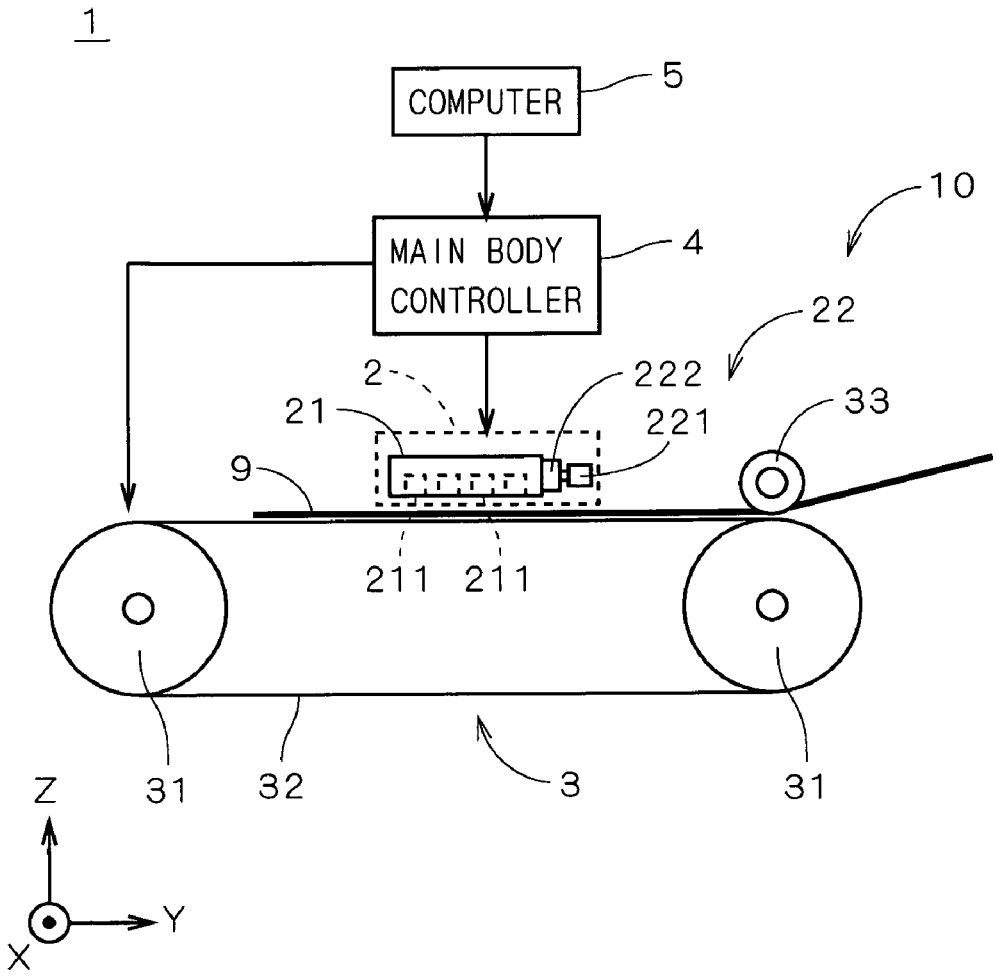
FIG. 1 illustrates a structure of a printing apparatus.

FIG. 1 illustrates a structure of an inkjet printing apparatus 1 according to one preferred embodiment of the present invention. The printing apparatus 1 includes a main body 10 and a computer 5 connected to the main body 10. The main body 10 includes an ejection part 2 for ejecting fine droplets (which will hereinafter be simply referred to as "droplets") of ink toward a printing paper 9, a feeder 3 for causing the printing paper 9 to move in a Y direction shown in FIG. 1 below the ejection part 2, and a main body controller 4 connected to the ejection part 2 and the feeder 3.

The feeder 3 includes two belt rollers 31 connected to a motor (not illustrated) and a belt 32 laid across the two belt rollers 31. The printing paper 9 is roll paper having a predetermined width. The printing paper 9 is guided onto the belt 32 via a roller 33 provided above one of the belt rollers 31 which is placed on the (+Y) side, to be held on the belt 32, and moves toward the (−Y) side together with the belt 32, having passed under the ejection part 2. Also, one of the belt rollers 31 of the feeder 3 includes an encoder (see FIG. 3). Additionally, the feeder 3 may further include a suction part in a position facing the ejection part 2, on an inner side face of the belt 32 shaped like a ring. To form small suction holes in the belt 32 could allow the printing paper 9 to be held on the belt 32 by suction.

Figure 2:
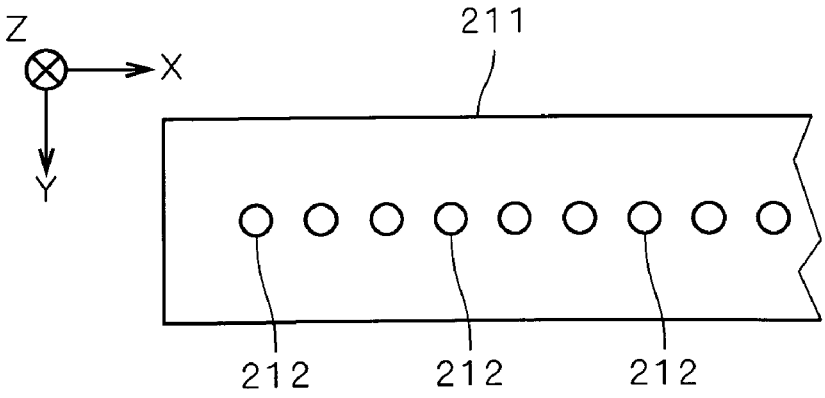
FIG. 2 is a bottom plan view of a head.

The ejection part 2 includes a head unit 21 including a plurality of heads 211. The plurality of heads 211, each of which ejects ink having any of colors of C, M, Y, and K, are arranged in the Y direction. FIG. 2 is a bottom plan view of one of the heads 211. In FIG. 2, a direction in which the printing paper 9 moves relative to the ejection part 2 (which direction is identical to the Y direction and will hereinafter be also referred to as a "direction of movement") runs vertically in illustrating one head 211. Referring to FIG. 2, a plurality of outlets 212 are formed and arranged in a direction which is perpendicular to a direction of movement of the printing paper 9 and along the printing paper 9, in a bottom of each of the heads 211. The direction of arrangement of the outlets 212 is identical to an X direction shown in FIG. 1, and will be hereinafter referred to as a "width direction" because the direction corresponds to the width of the printing paper 9. Each of the heads 211 further includes respective piezoelectric elements for the plurality of outlets 212. As such, to drive the piezoelectric elements would cause droplets of ink to be ejected from the outlets 212 toward the printing paper 9. Actually, the plurality of outlets 212 are arranged all over a width of printing area (area available for printing) of the printing paper 9 in the width direction, so that high-speed printing can be accomplished in one pass in the printing apparatus 1. Additionally, the head unit 21 may alternatively have a structure in which a plurality of heads are arranged in the X direction and a plurality of outlets each ejecting ink having one color are arranged all over a width of printing area of the printing paper 9 in a width direction.

Also, the ejection part 2 illustrated in FIG. 1 includes a head moving mechanism 22 for causing the head unit 21 to move in the width direction. The head moving mechanism 22 includes a timing belt 222 which is in the form of a ring elongating in the width direction, and a motor 221. Thus, the motor 221 cyclically moves the timing belt 222, to cause the head unit 21 to smoothly move in the width direction. During a time in which a printing process is not performed in the printing apparatus 1, the head moving mechanism 22 places the head unit 21 in a preset home position, where the plurality of outlets 212 of each head 211 in the head unit 21 are closed with a cover, to thereby prevent the outlets 212 from being clogged with dry ink in the vicinity of the outlets 212.

Figure 3:
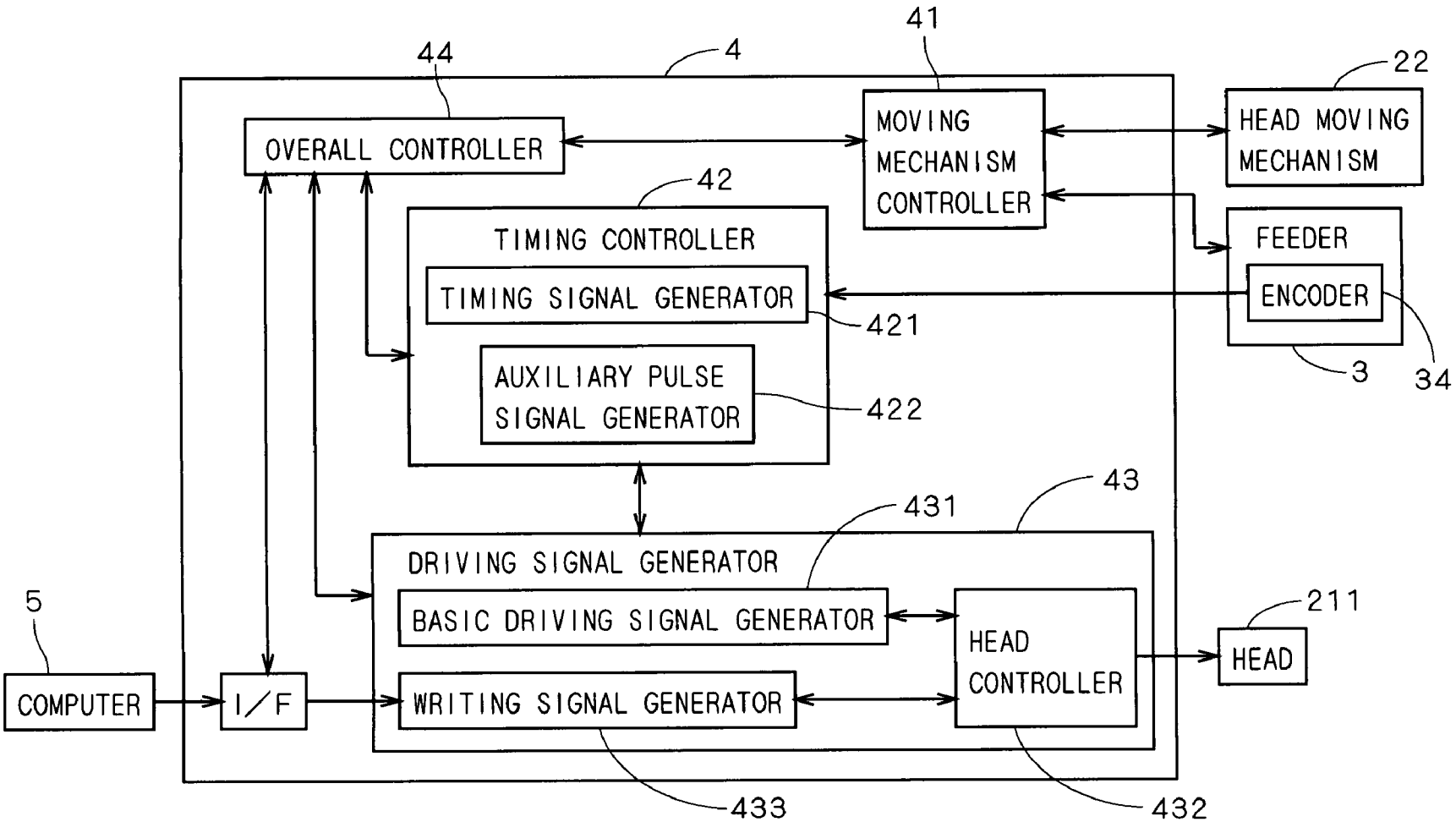
FIG. 3 is a block diagram illustrating a structure of a main body controller.

FIG. 3 is a block diagram illustrating a structure of the main body controller 4. The main body controller 4 includes a moving mechanism controller 41 which performs moving control over the head moving mechanism 22 and the feeder 3, a timing controller 42 which receives an encoder signal from an encoder 34 of the feeder 3 and controls a timing for ejection of droplets from the outlets 212 of the heads 211, a driving signal generator 43 which is connected to the computer 5 via an interface (I/F) and inputs a signal indicating an operation related to ejection of droplets to the heads 211, and an overall controller 44 which performs overall control of the main body controller 4. Additionally, although only one head 211 is illustrated in FIG. 3 for purposes of simplification, a signal is input to each of the plurality of heads 211 from the driving signal generator 43 in practice. The following description, which will be likewise made about one head 211 observed as an example, will hold true for all the heads 211.

The driving signal generator 43 includes a basic driving signal generator 431 for generating a basic wave signal which is fixed for the head 211 (which will hereinafter be referred to as a "basic driving signal"), a head controller 432 connected to the head 211, and a writing signal generator 433 for generating a writing signal for the head 211 on the basis of writing data which is input from the computer 5.

Figure 4:
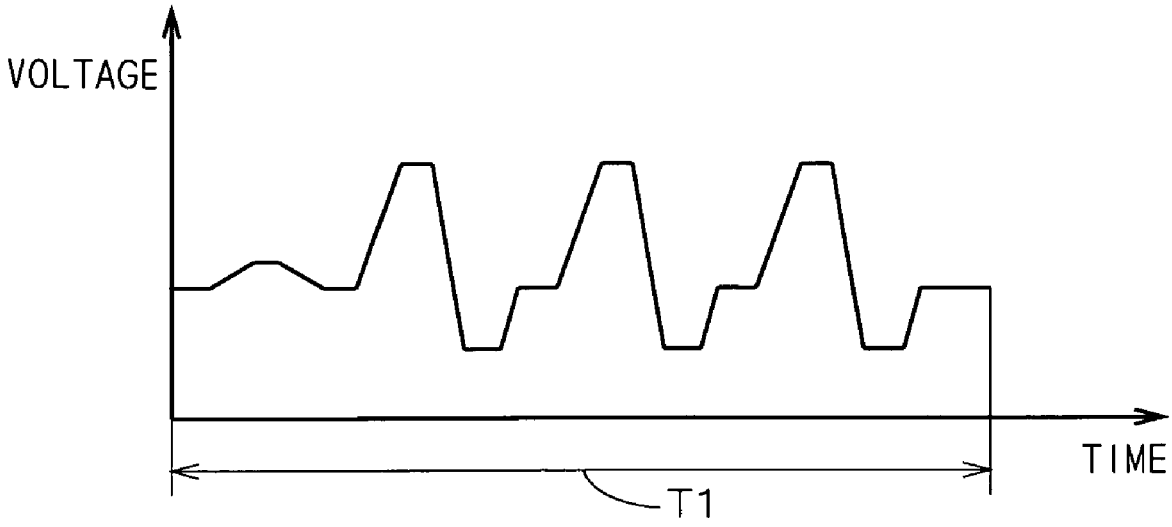
FIG. 4 illustrates a basic driving signal.

FIG. 4 illustrates the basic driving signal. The basic driving signal is a wave signal having a predetermined shape with a temporal length T1 thereof being set to 100 microseconds or smaller, for example, and is previously defined for the head 211. Basic operations of the driving signal generator 43 are as follows. First, a value which indicates whether or not ejection of droplets is necessary is input on the basis of writing data from the writing signal generator 433 to a register provided for each of the plurality of outlets 212 of the head 211 in the head controller 432. With the value being input to the register, the basic driving signal illustrated in FIG. 4 is input to the head controller 432 from the basic driving signal generator 431. In the head controller 432, the input basic driving signal is corrected for each of the outlets 212 in accordance with the value input to the corresponding register, and a set of corrected signals based on the writing data for the plurality of outlets 212 (which will hereinafter be simply referred to as a "driving signal") is input to the head 211. As a result, droplets are ejected from outlets 212 corresponding to registers each of which the value indicating ejecting droplet (writing) is input to. On the other hand, a non-ejecting motion (an oscillatory motion which is so slight that a droplet cannot be ejected from the outlet 212, for example) is performed in each of outlets 212 corresponding to registers each of which the value indicating non-ejecting (non-writing) is input to. In short, a motion related to ejection of droplet of ink which is either ejection of droplet or a non-ejecting motion is performed in each of the plurality of outlets 212 of the head 211 (i.e., an operation related to ejection of droplets is performed in the plurality of outlets 212), in response to input of a driving signal based on writing data from the driving signal generator 43. A function of each of components forming the timing controller 42 will be described in detail in later paragraphs dealing with specific operations in a printing process.

In the meantime, for a typical inkjet head, a time period with which a driving signal is input is fixed as a rated value for achieving highly accurate printing (a rated time period will be hereinafter be referred to as a "basic time period"). For the head 211 of the printing apparatus 1, a basic time period is set to 100 microseconds with an error within ±5%, (in other words, a rated driving frequency is 10 kilohertz (KHz) with an error within ±5%), for example. Accordingly, in the printing apparatus 1, for basic operations in a printing process on the printing paper 9, while the printing paper 9 continuously moves relative to the head 211 at a predetermined steady speed, a driving signal is input to the head 211 with the basic time period so that an operation related to ejection of droplets from the plurality of outlets 212 toward the printing paper 9 is performed. As a result, an image is printed on the printing paper 9 with a predetermined resolution (which is equal to the number of dots per certain distance in each of the direction of movement and the width direction of the printing paper 9, and is represented by using dpi (dot per inch), for example). In other words, each time the printing paper 9 which continuously moves at the steady speed travels a given distance which extends in the direction of movement of the printing paper 9 and is derived from the resolution, relative to the head 211, an operation related to ejection of droplets from the plurality of outlets 212 is performed. Additionally, the given distance that the printing paper 9 travels is equal to the smallest distance between two adjacent dots arranged in the direction of movement of the printing paper 9 in the image printed with the corresponding resolution, and will hereinafter be referred to as a "base distance".

In practice, even when a travel speed of the printing paper 9 relative to the head 211 is temporarily reduced to be lower than the steady speed, an image is printed on the printing paper 9 in the printing apparatus 1. Below, specific operations in a printing process performed on the printing paper 9 by the printing apparatus 1 will be described in detail with reference to FIG. 5.

In the printing apparatus 1, first, the moving mechanism controller 41 illustrated in FIG. 3 drives the head moving mechanism 22, so that the head unit 21 illustrated in FIG. 1 moves in the X direction, from the home position to a predetermined reference position. Subsequently, the feeder 3 is driven, so that the printing paper 9 starts to move (step S11). After a travel speed of the printing paper 9 becomes equal to one-nth (1/n) (where n is an integer equal to or larger than two) of the steady speed, the travel speed of the printing paper 9 is held constant. Then, an operator inputs a value n, which is assumed to be four in the present preferred embodiment, to the main body controller 4 via an entry section of the computer 5, so that the value n is previously set in the timing controller 42 and the driving signal generator 43. The following printing process which is performed with the travel speed of the printing paper 9 being set to one-nth of the steady speed will be referred to as "1/n-speed printing".

The timing signal generator 421 of the timing controller 42, first, checks that the travel speed of the printing paper 9 is held constant after becoming equal to a quarter of the steady speed, on the basis of an output provided from the encoder 34. Subsequently, an ejection timing signal is generated (step S12), and is output to the driving signal generator 43.

Figure 6:
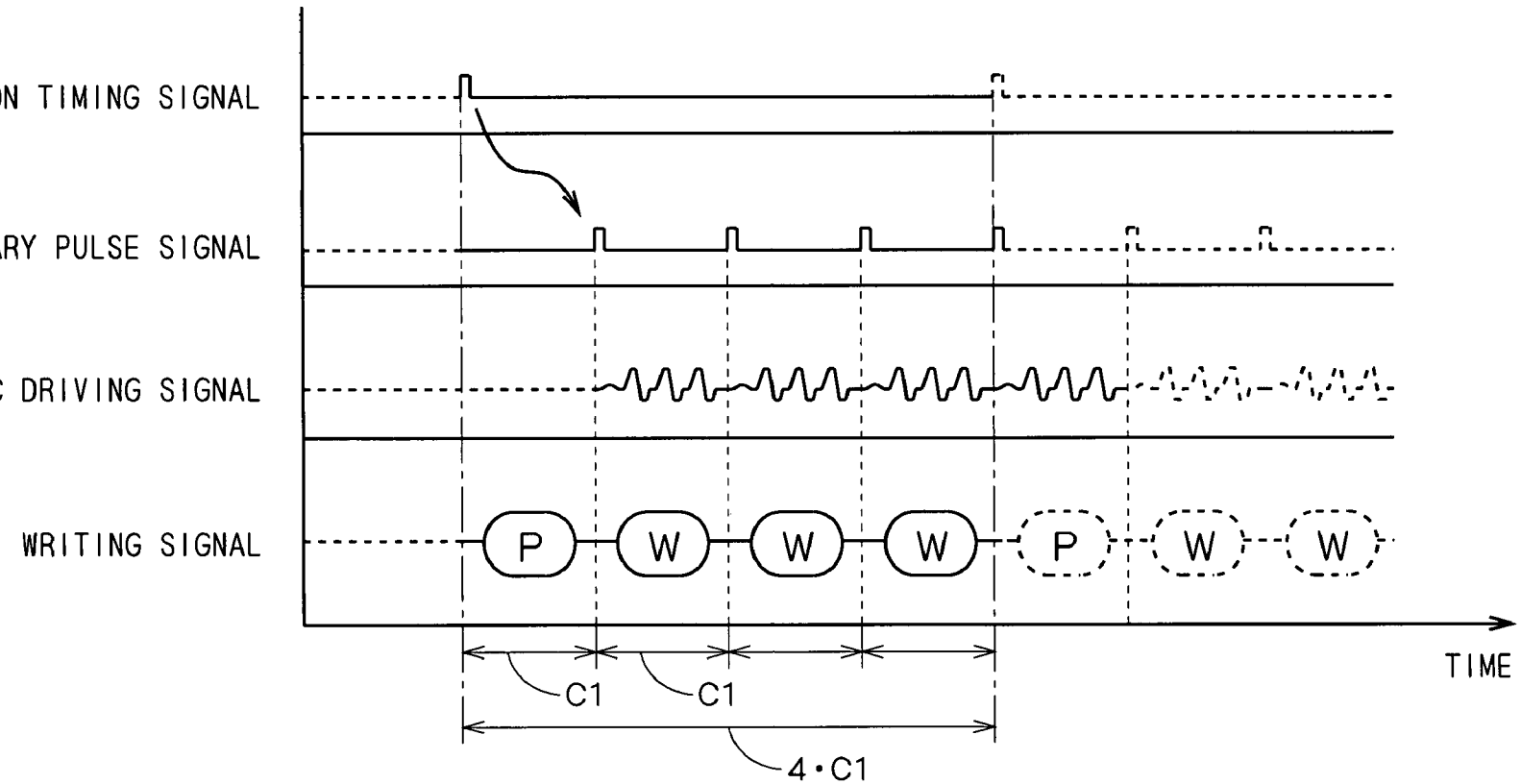
FIG. 6 illustrates signals respectively generated in components forming the main body controller.

FIG. 6 illustrates signals which are respectively generated in the components forming the main body controller 4 during ¼-speed printing. In the main body controller 4, pieces of writing data indicating an image which must be written on the printing paper 9 are sequentially input to the writing signal generator 433 from the computer 5. In synchronization with generation of the ejection timing signal which is illustrated by a solid line at the uppermost level in FIG. 6, a writing signal (corresponding to one line of the image indicated by the input writing data) which indicates whether or not first ejection of droplets from the plurality of outlets 212 of the head 211 is necessary is output to the head controller 432. Such output of the writing signal based on the input writing data to the head controller 432 from the writing signal generator 433 is represented by a box encircling "P" in a writing signal illustrated at the lowermost level in FIG. 6 (the same representation will be employed in FIG. 7, FIG. 9, and FIG. 11 which will be later referred to).

In an auxiliary pulse signal generator 422, when a basic time period (a time period denoted by a reference numeral "C1" in FIG. 6) passes after the ejection timing signal is generated, an auxiliary pulse signal is generated as illustrated at the second level from the top in FIG. 6. More specifically, an auxiliary pulse signal is generated with a delay of a basic time period with respect to generation of the ejection timing signal, and is output to the driving signal generator 43. In the basic driving signal generator 431, a basic driving signal is generated in synchronization with input of the auxiliary pulse signal as illustrated at the third level from the top in FIG. 6, and is output to the head controller 432. Then, the head controller 432 generates a driving signal for the plurality of outlets 212 on the basis of the input writing signal (the writing signal input in synchronization with generation of the ejection timing signal), and inputs the generated driving signal to the head 211 (step S13). In this manner, generation of an ejection timing signal causes input of a writing signal based on writing data, and a basic driving signal is input with a delay of a basic time period C1 with respect to generation of the ejection timing signal. Then, the head controller 432 impels the plurality of outlets 212 to perform an operation related to ejection of droplets based on writing data (namely, ejection of droplet or a non-ejecting motion in each outlet 212).

Also, in the writing signal generator 433, a writing signal indicating that all the outlets 212 do not write (a signal corresponding to dummy data representing one line of blank) is generated in response to input of the auxiliary pulse signal and is output to the head controller 432, concurrently with the foregoing operations in the basic driving signal generator 431. Such output of the writing signal indicating that the outlets 212 do not write, from the writing signal generator 433 to the head controller 432, is represented by a box encircling "W" at the lowermost level in FIG. 6 (the same representation will be employed in FIG. 9 and FIG. 11 which will be later referred to).

In the auxiliary pulse signal generator 422, when a basic time period C1 passes after generation of the first auxiliary pulse signal, the second auxiliary pulse signal is generated. Subsequently, a basic driving signal is generated in response to input of the second auxiliary pulse signal in the basic driving signal generator 431 and is output to the head controller 432. Then, the head controller 432 inputs a non-ejection driving signal which is a driving signal ordering the plurality of outlets 212 to perform a non-ejecting operation, to the head 211. As a result, each of the plurality of outlets 212 of the head 211 performs a non-ejecting motion (i.e., the plurality of outlets 212 perform a non-ejecting operation.). Also, in synchronization with input of the second auxiliary pulse signal, a writing signal which orders all the outlets 212 not to write is input from the writing signal generator 433 to the head controller 432.

Further in the auxiliary pulse signal generator 422, when a basic time period C1 passes after generation of the second auxiliary pulse signal, the third auxiliary pulse signal is generated, and the plurality of outlets 212 of the head 211 perform a non-ejecting operation in response to input of the non-ejection driving signal from the head controller 432 to the head 211. On the other hand, a writing signal indicating that all the outlets 212 do not write is input to the head controller 432. Then, when a basic time period C1 passes after generation of the third auxiliary pulse signal, the fourth auxiliary pulse signal is generated, and the plurality of outlets 212 of the head 211 perform a non-ejecting operation in response to input of the non-ejection driving signal from the head controller 432 to the head 211. At that time, a writing signal which is in synchronization with generation of the fourth auxiliary pulse signal and indicates non-writing is not output in the writing signal generator 433.

As just described, n (four) auxiliary pulse signals are sequentially generated with a basic time period C1 after an ejection timing signal is generated in the auxiliary pulse signal generator 422. Then, each time an auxiliary pulse signal is generated, the basic driving signal generator 431 outputs a basic driving signal to the head controller 432 and the writing signal generator 433 outputs a writing signal indicating non-writing to the head controller 432 (except when the nth auxiliary pulse signal is input). As a result, a non-ejection driving signal is input to the head 211 when each of the second, third, and fourth auxiliary pulse signals is generated, so that the plurality of outlets 212 perform a non-ejecting operation (step S14).

Actually, at the substantially same time as generation of the fourth auxiliary pulse signal in the auxiliary pulse signal generator 422, the fact that the printing paper 9 travels a base distance from a position where the printing paper 9 is placed at a time of generation of the most recent ejection timing signal is detected on the basis of an output provided from the encoder 34 in the timing signal generator 421, and a next ejection timing signal illustrated by a broken line at the uppermost level in FIG. 6 is generated (steps S15 and S12). As a result, a writing signal based on writing data is input to the head controller 432. Subsequently, one auxiliary pulse signal is newly generated after the next ejection timing signal is generated, so that a basic driving signal is input to the head controller 432 and a driving signal for the plurality of outlets 212 is input to the head 211 (step S13). Also, when each of the second, third, and fourth auxiliary pulse signals is generated, a non-ejection driving signal is input to the head 211 so that the plurality of outlets 212 perform a non-ejecting operation (step S14).

The above-described operations in the steps S12, S13, and S14 are repeated in the printing apparatus 1 (step S15), so that an ejection timing signal is generated each time the printing paper 9 moving at a speed equal to one-nth of the steady speed travels a base distance relative to the head 211 (step S12). Subsequently, a driving signal for an operation related to ejection of droplets based on writing data is input to the head 211 each time an ejection timing signal is generated (strictly, each time a basic time period C1 passes after generation of an ejection timing signal) (step S13). Then, three (n−1) non-ejection driving signals are input to the head 211 between a driving signal associated with one ejection timing signal and a driving signal associated with a next ejection timing signal generated subsequently to the one ejection timing signal (step S14). As a result, it is possible to cause the head 211 to perform an operation related to ejection of droplets with a basic time period while making a time period between ejection of ink based on writing data associated with the one ejection timing signal (which includes a case where no ink is ejected on the basis of writing data) and ejection of ink based on the writing data associated with the next ejection timing signal, equal to four times the basic time period of driving signal which is fixed for the head 211, to thereby reliably accomplish ¼-speed printing with high accuracy.

When an operator checks quality of an image which is printed on the printing paper 9 by ¼-speed printing (so-called print quality check), to determine that the quality is acceptable, the operator provides some input to the main body controller 4 via the computer 5, so that ¼-speed printing is terminated and the travel speed of the printing paper 9 is changed to the steady speed (steps S15 and S16). Then, a printing process at the steady speed (in other words, 1-speed printing) is performed. Although the travel speed of the printing paper 9 is rapidly increased to the steady speed in the printing apparatus 1, additional operations for printing (printing operations) may be performed while the travel speed of the printing paper 9 is increasing to the steady speed, as needed. Details of such additional printing operations during acceleration will be later described.

Figure 7:
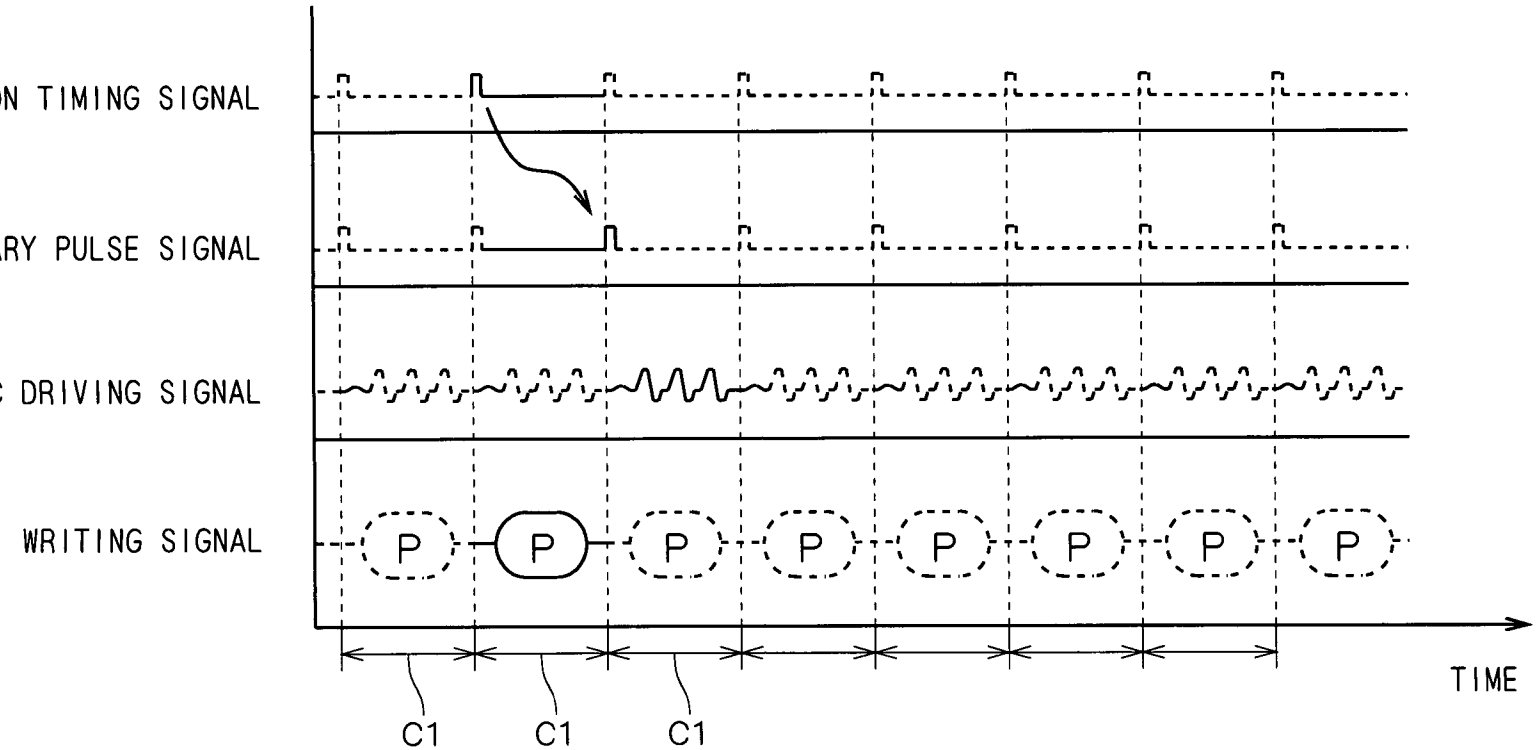
FIG. 7 illustrates signals respectively generated in components forming the main body controller.

FIG. 7 illustrates signals which are respectively generated in the components forming the main body controller 4 in 1-speed printing. In 1-speed printing, an ejection timing signal is generated with a basic time period C1 as illustrated at the uppermost level in FIG. 7 (step S17), and a writing signal based on writing data is input from the writing signal generator 433 to the head controller 432 in response to generation of the ejection timing signal as illustrated at the lowermost level in FIG. 7. Then, one auxiliary pulse signal is generated with a delay of a basic time period C1 with respect to generation of the ejection timing signal as illustrated at the second level from the top in FIG. 7, so that a basic driving signal is input from the basic driving signal generator 431 to the head controller 432 as illustrated at the third level from the top in FIG. 7, and a driving signal for the plurality of outlets 212 is input to the head 211 from the head controller 432 (step S18). The above-described operations in the step S17 and S18 are repeated with a basic time period C1 in the printing apparatus 1 (step S19), so that ejection of ink based on the writing data is performed with a basic time period C1 on the printing paper 9 which moves at the steady speed. Then, when an entire image indicated by the writing data is printed on the printing paper 9 (step S19), the printing paper 9 stops moving, to terminate printing operations in the printing apparatus 1 (step S20).

As described above, in the printing apparatus 1 illustrated in FIG. 1, in a case where the travel speed of the printing paper 9 relative to the head 211 temporarily becomes equal to one-nth of the steady speed and an ejection interval between generation of one ejection timing signal and generation of a next ejection timing signal generated subsequently to the one ejection timing signal is equal to n times the basic time period, a non-ejection driving signal which is a driving signal indicating a non-ejecting operation is input to the head 211 between two driving signals respectively associated with the one ejection timing signal and the next ejection timing signal. As a result, it is possible to reliably and properly perform ejection of ink based on writing data with a time period which is equal to n times the basic time period of driving signal. Accordingly, also in a case where the travel speed of the printing paper 9 relative to the head 211 is temporarily reduced to be lower than the steady speed where an ejection timing signal is generated with a basic time period, it is possible to reliably accomplish highly accurate printing with the same resolution as a resolution achieved by 1-speed printing in which the printing paper 9 moves at the steady speed.

Figure 8:
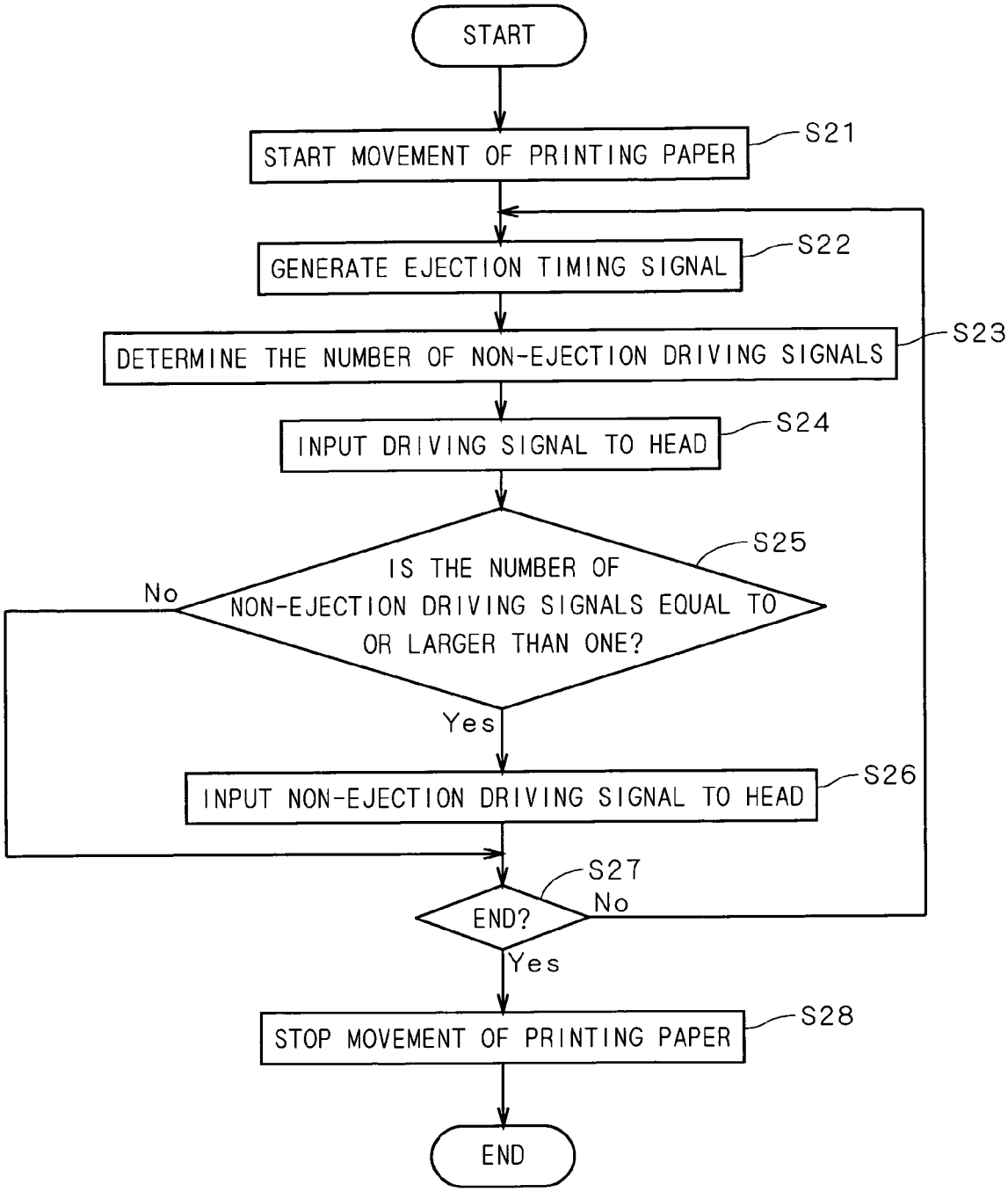
FIG. 8 is a flow chart illustrating a process flow of another example of operations in a printing process performed on a printing paper by the printing apparatus.

Next, another example of operations in the printing apparatus 1 will be described. FIG. 8 is a flow chart illustrating a process flow of another example of operations in a printing process performed on the printing paper 9 by the printing apparatus 1. Steps S22 through S27 can be regarded as generalizations of each of the steps S12 through S15 and S17 through S19 in FIG. 5.

According to another example of operations in the printing apparatus 1, when the feeder 3 is driven with the head unit 21 being placed in a reference position, the printing paper 9 starts to move (step S21), and subsequently, the travel speed of the printing paper 9 is gradually increased (in other words, the travel speed of the printing paper 9 is slowly increased.). In the very beginning of movement of the printing paper 9, in which the travel speed of the printing paper 9 is much lower than the steady speed, the timing signal generator 421 generates an ejection timing signal after acknowledging the fact that the printing paper 9 travels a base distance from the position at which the printing paper 9 starts to move, on the basis of an output provided from the encoder 34 (step S22). Then, the initial steps S23, S24, S25, and S26 for printing operations in the process flow illustrated in FIG. 8 are skipped, and the process flow returns to the step S22 (step S27) in the printing apparatus 1. Then, when the printing paper 9 travels a base distance after the most recent ejection timing signal is generated, the second ejection timing signal is generated (step S22).

Figure 9:
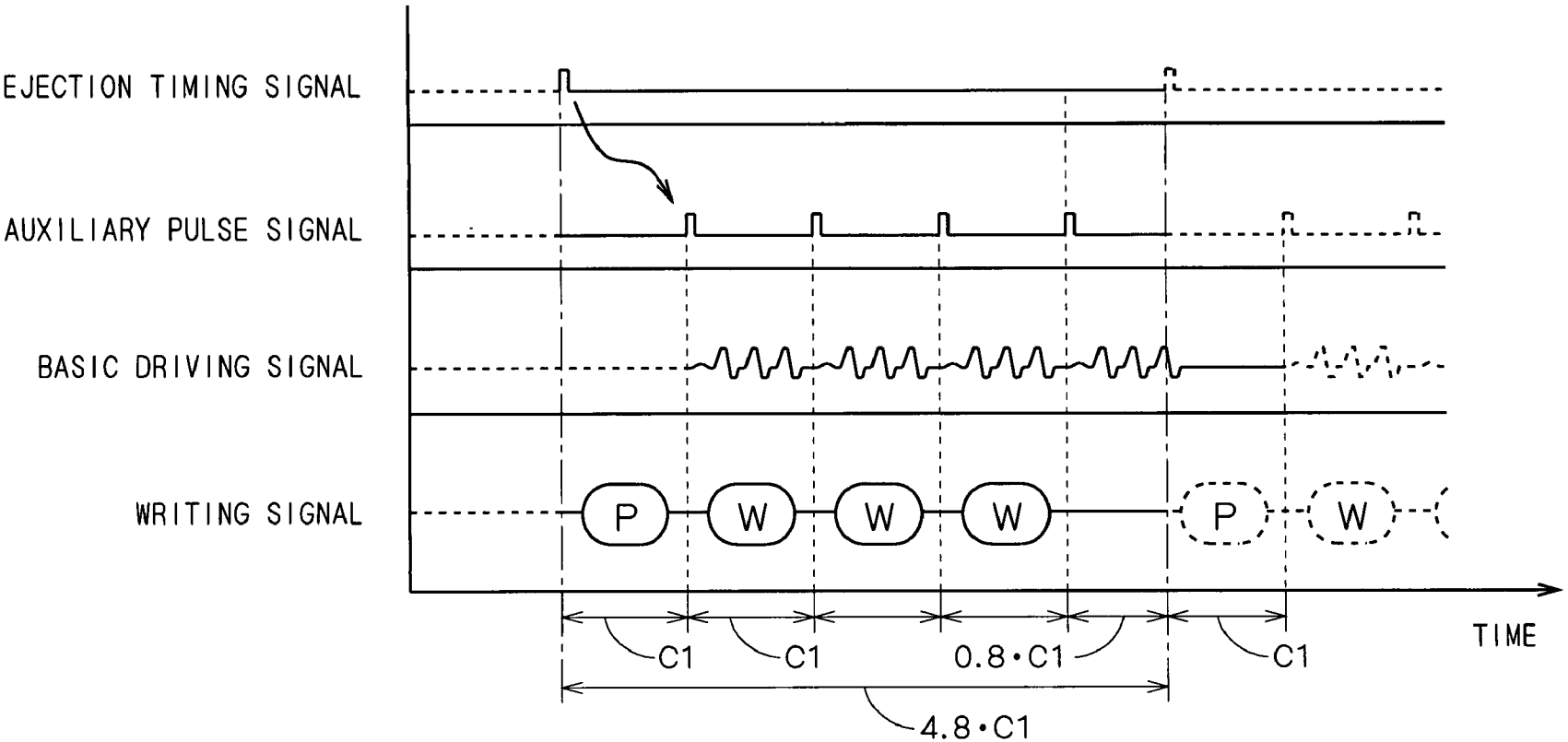
FIG. 9 illustrates signals respectively generated in components forming the main body controller.

FIG. 9 illustrates signals which are respectively generated in the components forming the main body controller 4 in response to generation of an ejection timing signal. When the second ejection timing signal is generated as illustrated by a solid line at the uppermost level in FIG. 9, the first writing signal based on writing data is input from the writing signal generator 433 to the head controller 432 for the plurality of outlets 212, as illustrated by the lowermost level in FIG. 9.

Concurrently with input of the writing signal to the head controller 432, a quotient resulting from division of a time period obtained by subtracting an extremely short time, for example, one-fifth of the basic time period (0.2 times the basic time period), from an ejection interval between the first ejection timing signal and the second ejection timing signal, by a basic time period, is determined as the number of auxiliary pulse signals in the overall controller 44. Then, the foregoing quotient as the number of auxiliary pulse signals is output to the timing controller 42 and the driving signal generator 43 (step S23). In the present discussion, it is assumed that the number of auxiliary pulse signals is determined to be four, for purposes of explanation. However, the number of auxiliary pulse signals which is determined on the basis of the ejection interval between the first ejection timing signal and the second ejection timing signal is much larger than four, actually. Additionally, an operation in the step S23 is an operation for obtaining the number of non-ejection driving signals in effect, as later described in detail. Also, in the above-described printing operations referring to FIG. 5, an operation corresponding to the step S23 is omitted because the number of non-ejection driving signals (auxiliary pulse signals) is previously determined. Nonetheless, an operation similar to the operation in the step S23 can be performed in the example illustrated in FIG. 5 by assuming that an extremely short time is zero.

In the auxiliary pulse signal generator 422, after the second ejection timing signal is generated, four auxiliary pulse signals are sequentially generated with a basic time period C1 as illustrated at the second level from the top in FIG. 9. In the basic driving signal generator 431, a basic driving signal is generated as illustrated at the third level from the top in FIG. 9, in response to input of the first auxiliary pulse signal which is generated with a delay of a basic time period C1 with respect to generation of the second ejection timing signal. The generated basic driving signal is output to the head controller 432. Then, the head controller 432 inputs a driving signal based on writing data for the plurality of outlets 212 to the head 211 (step S24). At the same time, the writing signal generator 433 outputs a writing signal which indicating that all the outlets 212 do not write to the head controller 432 as illustrated at the lowermost level in FIG. 9.

In the printing apparatus 1, each time an auxiliary pulse signal is generated, the basic driving signal generator 431 outputs a basic driving signal to the head controller 432 and the writing signal generator 433 outputs a writing signal indicating non-writing to the head controller 432 (except when the last auxiliary pulse signal is generated). As a result, when each of the second, third, and fourth auxiliary pulse signals is generated, a non-ejection driving signal is input to the head 211, so that the plurality of outlets 212 perform a non-ejecting operation (steps S25 and S26).

Then, when the printing paper 9 travels a base distance from a position where the printing paper 9 has been placed at a time of generation of the second ejection timing signal, the third ejection timing signal is generated as illustrated by a broken line at the uppermost level in FIG. 9 (steps S27, S22). According to the example illustrated in FIG. 9, when a time period equal to four-fifths of basic time period C1 (0.8 times the basic time period C1) passes after the fourth auxiliary pulse signal based on the second ejection timing signal is generated, the third ejection timing signal is generated. Thus, an ejection interval between generation of the second ejection timing signal and generation of the third ejection timing signal is 4.8 times the basic time period C1.

In the printing apparatus 1, in response to generation of the third ejection timing signal, the writing signal generator 433 outputs a writing signal based on writing data to the head controller 432, and also the number of auxiliary pulse signals is determined on the basis of an ejection interval between the second ejection timing signal and the third ejection timing signal in the overall controller 44 (step S23). Then, when a basic time period C1 passes after generation of the third ejection timing signal, the first auxiliary pulse signal is generated, so that a driving signal is input to the head 211 (step S24).

The number of non-ejection driving signals input to the head 211 during a time between two driving signals respectively associated with the second ejection timing signal and the third ejection timing signal is equal to a value obtained by subtracting one from the number of auxiliary pulse signals which is calculated at a time of generation of the second ejection timing signal. Accordingly, an operation for determining the number of auxiliary pulse signals in the step S23 when the second ejection timing signal is generated can be regarded as an operation for obtaining the number of non-ejection driving signals in effect. Thus, a value (a time period) is obtained by subtracting an extremely short time shorter than the basic time period from an ejection interval preceding to an ejection interval between the second ejection timing signal and the third ejection timing signal (i.e., an ejection interval between the first ejection timing signal and the second ejection timing signal), and the number of non-ejection driving signals is obtained by subtracting one from a quotient resulting from division of the value by the basic time prtiod. Therefore, a sum of respective lengths of a driving signal and non-ejection driving signals (or a non-ejection driving signal) is prevented from being longer than an ejection interval in the very beginning of movement of the printing paper 9, in which the travel speed of the printing paper 9 greatly changes. Hence, absence of a driving signal on the way is avoided.

At that time, an interval between the non-ejection driving signal input to the head 211 in response to generation of the fourth auxiliary pulse signal associated with the second ejection timing signal and a driving signal input to the head 211 in response to generation of the first auxiliary pulse signal associated with the third ejection timing signal is longer than the basic time period (1.8 times the basic time period in the present example). Nonetheless, such relatively long interval occurs only locally, and thus does not cause any problem. Thereafter, when each of the second and later auxiliary pulse signals is generated, a non-ejection driving signal is input to the head 211, so that the outlets 212 performs a non-ejecting operation (steps S25 and S26).

Figure 10:
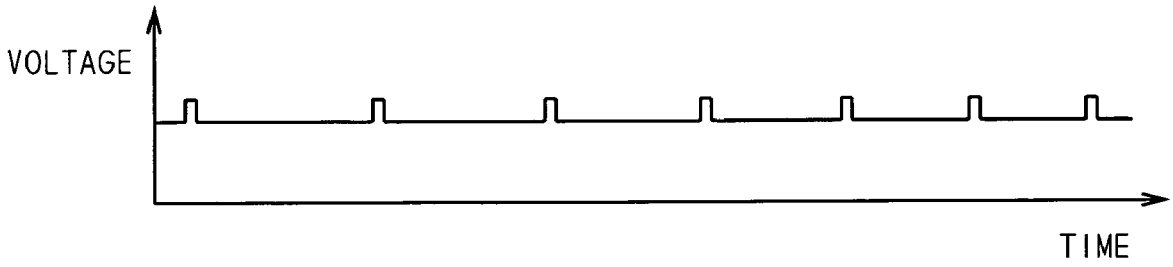
FIG. 10 illustrates a change in an ejection interval.
Figure 11:
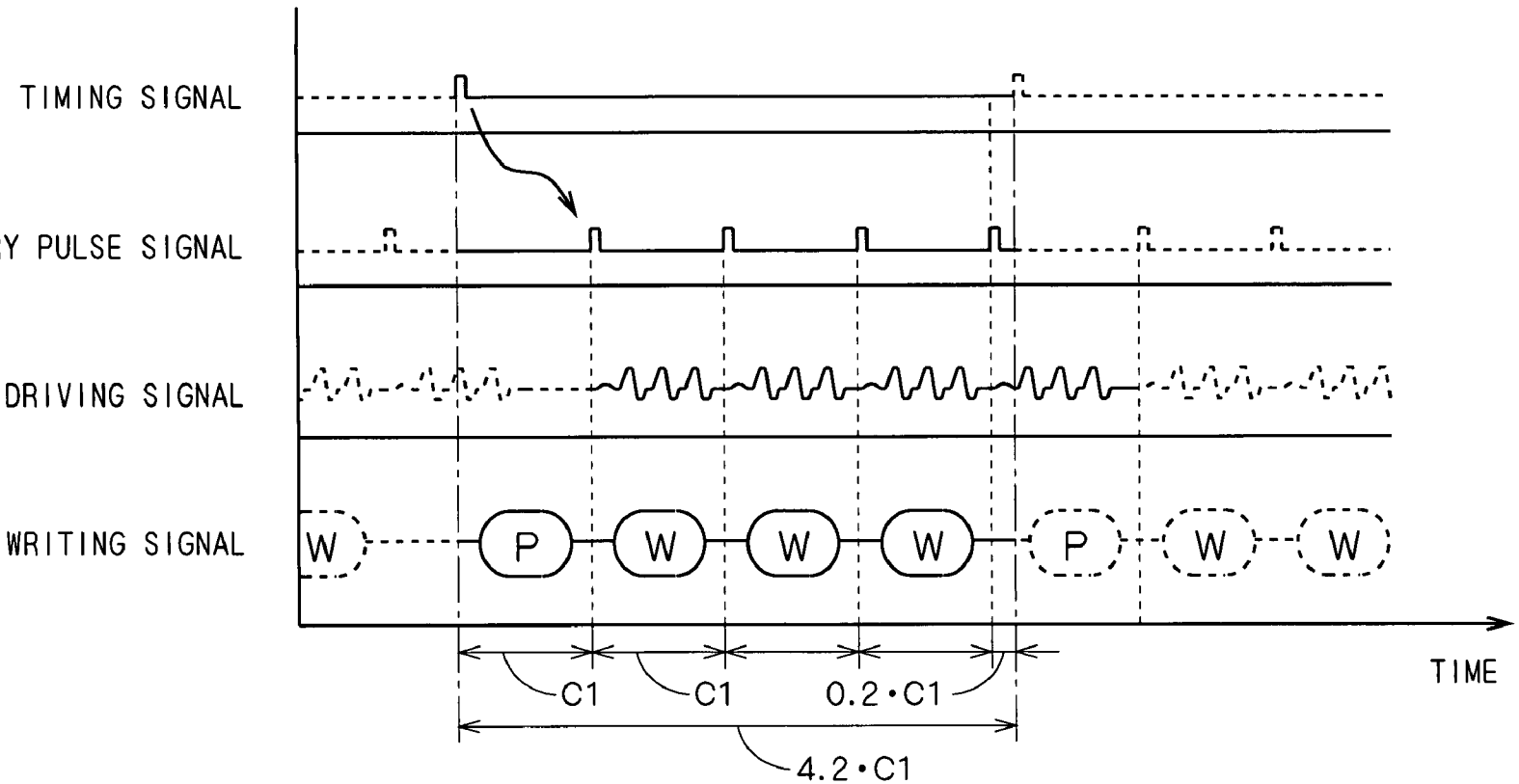
FIG. 11 illustrates signals respectively generated in components forming the main body controller.

In the printing apparatus 1, the above-described steps S22 through S26 are repeated while the travel speed of the printing paper 9 is gradually increased (step S27). Therefore, ejection intervals, each of which is a time period between one ejection timing signal and a next ejection timing signal generated subsequently to the one ejection timing signal, sequentially and gradually decreases as illustrated in FIG. 10, and thus an ejection interval between a given ejection timing signal which is any one of the third and later ejection timing signals and a next ejection timing signal generated subsequently to the given ejection timing signal is equal to 4.2 times the basic time period C1, for example, as illustrated in FIG. 11. Also, when an ejection interval becomes equal to approximately twice the basic time period, the number of auxiliary pulse signals which is determined in the step S23 is one, so that only one auxiliary pulse signal is generated after generation of an ejection timing signal and a driving signal is input to the head 211 (step S24). In the foregoing case, the number of non-ejection driving signals is zero, so that the step S26 is not performed, in other words, a non-ejection driving signal is not input to the head 211 (step S25). Then, after the travel speed of the printing paper 9 increases to the steady speed, the travel speed is held constant and an ejection interval which should be equal to the basic time period is held constant. In this state, the above-described steps S22 through S26 are repeated (step S27). Additionally, printing operations performed while the travel speed of the printing paper 9 is equal to the steady speed are identical to the printing operations in 1-speed printing which have been described above (refer to FIG. 5: steps S17, S18, and S19), actually.

After a most part of an image indicated by writing data is printed on the printing paper 9, the travel speed of the printing paper 9 gradually decreases (in other words, the travel speed of the printing paper 9 is slowed down). In the printing apparatus 1, if the most recent ejection interval which is determined by generation of an ejection timing signal in the step S22 is equal to or longer than a sum of twice the basic time period and the extremely short time, the number of auxiliary pulse signals is determined to be two or more in the overall controller 44 (step S23). Subsequently, an auxiliary pulse signal is generated and a driving signal is input to the head 211 (step S24). Then, when each of the other auxiliary pulse signals is generated, a non-ejection driving signal is input to the head 211 (steps S25 and S26).

Thus, the above-described steps S22 through S26 are repeated even immediately before the printing paper 9 stops moving (step S27) in the printing apparatus 1. Then, the printing paper 9 stops moving at the substantially same time as an entire image indicated by writing data is printed on the printing paper 9 (step S28).

As described above, according to another example of operations in the printing apparatus 1, in a case where an ejection interval between one ejection timing signal and a next ejection timing signal generated subsequently to the one ejection timing signal is presumed to be equal to or longer than a sum of twice the basic time period of input of driving signal and the extremely short time immediately after the printing paper 9 starts to move relative to the head 211 and immediately before the printing paper 9 stops moving, a non-ejection driving signal(s) is input to the head 211 between two driving signals respectively associated with the one ejection timing signal and the next ejection timing signal. As a result, it is possible to reliably accomplish highly accurate printing with the same resolution as the resolution achieved by 1-speed printing immediately after the printing paper 9 starts to move relative to the head 211 and immediately before the printing paper 9 stops moving, to thereby suppress a waste of the printing paper 9 and shorten a printing time.

Also, in the printing apparatus 1, the number of non-ejection driving signals between two driving signals respectively associated with one ejection timing signal and a next ejection timing signal generated subsequently to the one ejection timing signal is determined on the basis of an ejection interval preceding to an ejection interval between the one ejection timing signal and the next ejection timing signal. As a result, it is possible to easily estimate an ejection interval and easily determine the number of non-ejection driving signals.

Figure 5:
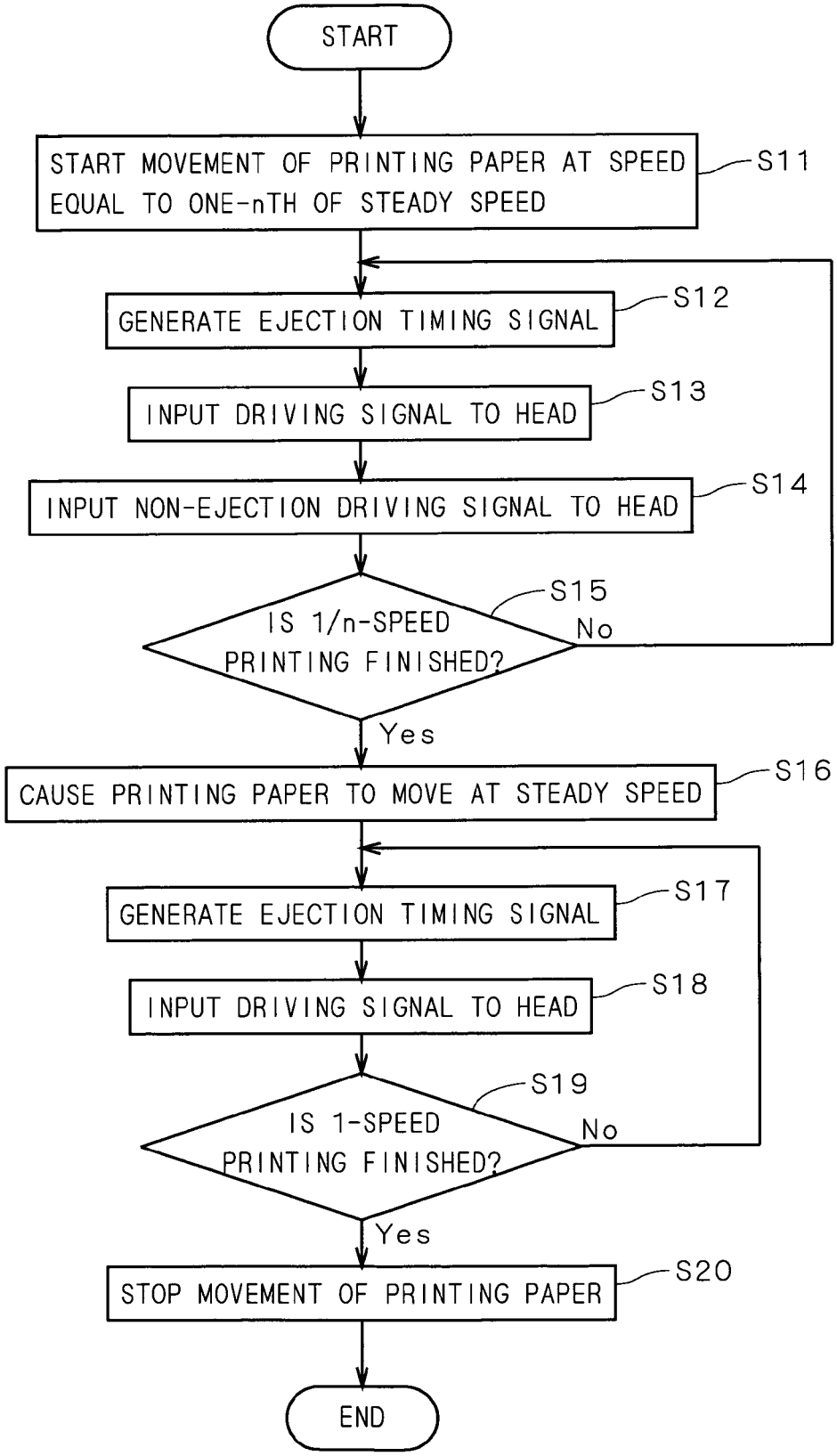
FIG. 5 is a flow chart illustrating a process flow of one example of operations in a printing process performed on a printing paper by the printing apparatus.

Additionally, the above-described operations of inserting a non-ejection driving signal(s) while determining the number of non-ejection driving signals between two driving signals respectively associated with one ejection timing signal and a next ejection timing signal generated subsequently to the one ejection timing signal may be employed in 1/n/-speed printing illustrated in FIG. 5 at times of: a time when the travel speed of the printing paper 9 increases immediately after the printing paper 9 starts to move; a time when the travel speed of the printing paper 9 increases from one-nth of the steady speed to the steady speed; and a time when the travel speed of the printing paper 9 decreases immediately before the printing paper 9 stops moving.

Further, according to the above-described example of operations in the printing apparatus 1, writing data is input to the writing signal generator 433 from the computer 5 concurrently with printing operations. However, in 1-speed printing of the printing apparatus 1, when a transfer speed at which writing data is transferred from the computer 5 to the writing signal generator 433 is lower than a input speed at which a driving signal is input from the head controller 432 to the head 211 with the basic time period (in other words, when a time required for transferring data corresponding to one line of an image to the writing signal generator 433 is longer than the basic time period), a portion of the writing data which is associated with a given ejection timing signal is not input to the writing signal generator 433 so that a driving signal which is supposed to be input to the head 211 in response to generation of the given ejection timing signal cannot be input to the head 211 in the course of printing in some cases.

Even in the foregoing situation, the travel speed of the printing paper 9 is slowed down from the steady speed where an ejection timing signal is generated with the basic time period, to become equal to one-nth of the steady speed (where n is an integer equal to or larger than two) while printing operations continue to be performed, in the printing apparatus 1. Actually, a value n in accordance with a transfer speed of writing data, which ensures that input of the portion of the writing data which is associated with a given ejection timing signal to the writing signal generator 433 is finished at the time of generation of the given ejection timing signal, is determined through a predetermined calculation in the overall controller 44. As a result, it is possible to reliably accomplish highly accurate printing while reducing the travel speed of the printing paper 9 in accordance with the transfer speed of writing data to be lower than the steady speed in the printing apparatus 1. Moreover, in a case where the transfer speed of writing data increases in the course of printing, the travel speed of the printing paper 9 is slowly increased to the steady speed (or one-mth (where m is an integer smaller than n and equal to or large than two) of the steady speed) while printing operations continue to be performed, to thereby accomplish printing at a higher speed.

Hereinbefore, the preferred embodiments of the present invention have been described. However, the present invention is not limited to the above-described preferred embodiments, and various modifications are possible.

According to the above-described preferred embodiments, the head 211 for which a rated basic time period is previously determined is used. However, also in a case where a head for which a basic time period is not fixed as a rated value is used, to use a non-ejection driving signal(s) allows ink to be ejected with higher reliability in the printing apparatus 1 as compared to a case where a non-ejection driving signal is not used. In order to use a non-ejection driving signal in the foregoing case, a time period of driving signal for performing a printing process in which the printing paper 9 moves at a constant speed is employed as a basic time period. Then, when an ejection interval is much longer than the basic time period, at least one non-ejection driving signal is input to the head to cause the head to perform at least one non-ejecting operation. In this manner, higher reliability in ejecting ink can be achieved.

Also, according to the example of operations illustrated in FIG. 8, an extremely short time is taken into account in obtaining the number of non-ejection driving signals in effect. However, when the travel speed of the printing paper 9 is decreased, it is not necessarily required to take into account an extremely short time in terms of preventing a sum of respective lengths of a driving signal and a non-ejection driving signal(s) from being longer than an ejection interval. When the travel speed of the printing paper 9 decreases, if an ejection interval is estimated to be equal to or longer than twice the basic time period, the number of non-ejection driving signals is determined to be one or more.

As is made clear from the foregoing, it is important that at least one non-ejection driving signal is input to the head 211 between two driving signals respectively associated with one ejection timing signal and a next ejection timing signal generated subsequently to the one ejection timing signal in a case where an ejection interval between generation of the one ejection timing signal and generation of the next ejection timing signal is equal to or longer than twice a basic time period of input of driving signal which is fixed for the head 211, in the printing apparatus 1. By ensuring input of at least one non-ejection driving signal to the head 211 as just described, it is possible to reliably and properly perform ejection of ink based on writing data with a time period which is equal to or longer than twice the basic time period of driving signal.

According to the above-described preferred embodiments, generation of an ejection timing signal, input of a driving signal to the head 211, and input of a non-ejection driving signal(s) to the head 211 as needed, are performed immediately after the printing paper 9 starts to move relative to the head 211 and immediately before the printing paper 9 stops moving. However, by performing the foregoing operations at least either immediately after the printing paper 9 starts to move relative to the head 211 or immediately before the printing paper 9 stops moving, a waste of the printing paper 9 can be suppressed.

The number of non-ejection driving signals between two driving signals respectively associated with one ejection timing signal and a next ejection timing signal generated subsequently to the one ejection timing signal is determined on the basis of an ejection interval which precedes by one to, and thus is approximate to, an ejection interval between the one ejection timing signal and the next ejection timing signal in the printing apparatus 1. However, the number of non-ejection driving signals may alternatively be determined on the basis of a earlier ejection interval which precedes by two or three to the ejection interval between the one ejection timing signal and the next ejection timing signal, because an ejection interval is extremely short and the travel speed of the printing paper 9 does not drastically change in normal conditions. In other words, the number of non-ejection driving signals may be determined based on an ejection interval which precedes by a predetermined number of intervals to a concerned ejection interval. This makes it possible to easily estimate an ejection interval and easily determine the number of non-ejection driving signals.

An ejection timing signal is not necessarily required to be generated on the basis of an output provided from the encoder 34, in the timing signal generator 421. For example, in a case where a distance that the printing paper 9 is caused to travel by the feeder 3 is controlled by the moving mechanism controller 41 in accordance with a clock signal within the main body controller 4, an ejection timing signal can alternatively be generated by count of clock signals in the timing signal generator 421. Also in the foregoing case, it is possible to generate an ejection timing signal each time the printing paper 9 travels a predetermined distance.

Though the printing paper 9 is caused to move relative to the head unit 21 (the head 211) by the feeder 3 in the printing apparatus 1, the head unit 21 may move relative to the printing paper 9 in the Y direction. In other words, it is sufficient that relative movement between the printing paper 9 and the head unit 21 is provided. Also, a head capable of ejecting multi-tone ink (capable of forming dots having different sizes, for example) may be used in the printing apparatus 1.

In the above-described preferred embodiments, to use roll paper as a printing medium contributes to efficient use of the printing medium and reduction of printing cost (through suppression of a waste of paper). However, a printing medium in the printing apparatus 1 can be a printing paper other than roll paper, a film, or the like.

While the invention has been shown and described in detail, the foregoing description is in all aspects illustrative and not restrictive. It is therefore understood that numerous modifications and variations can be devised without departing from the scope of the invention.

This application claims priority benefit under 35 U.S.C. Section 119 of Japanese Patent Application No. 2005-255980 filed in the Japan Patent Office on Sep. 5, 2005, the entire disclosure of which is incorporated herein by reference.

What is claimed is:

1. A printing method using an inkjet head, comprising the steps of:

a) causing a printing medium to move in a predetermined direction of movement relative to a head which ejects droplets of ink from a plurality of outlets toward said printing medium;

b) generating an ejection timing signal each time said printing medium travels a predetermined distance relative to said head, concurrently with said step a);

c) inputting a driving signal for an operation related to ejection of droplets from said plurality of outlets based on writing data, to said head each time said ejection timing signal is generated; and d) inputting at least one non-ejection driving signal, each of which is a driving signal indicating a non-ejecting operation, to said head between driving signals respectively associated with one ejection timing signal and a next ejection timing signal generated subsequently to said one ejection timing signal in a case where an ejection interval which is a time period between generation of said one ejection timing signal and generation of said next ejection timing signal in said step b) is equal to or longer than twice a basic time period of input of driving signal which is fixed for said head.

2. The printing method according to claim 1, wherein the number of said at least one non-ejection driving signal is determined on the basis of a preceding ejection interval which precedes by a predetermined number of intervals to said ejection interval between said one ejection timing signal and said next ejection timing signal.

3. The printing method according to claim 2, wherein a value is obtained by subtracting a predetermined extremely short time shorter than said basic time period from said preceding ejection interval, and the number of said at least one non-ejection driving signal is obtained by subtracting one from a quotient resulting from division of said value by said basic time period.

4. The printing method according to claim 1, wherein said head includes piezoelectric elements.

5. The printing method according to claim 1, wherein a travel speed of said printing medium relative to said head is temporarily reduced to be lower than a steady speed where said ejection timing signal is generated with said basic time period in said step a).

6. The printing method according to claim 1, wherein a travel speed of said printing medium relative to said head is reduced in accordance with a transfer speed at which said writing data is transferred to a driving signal generator for generating said driving signal, to be lower than a steady speed where said ejection timing signal is generated with said basic time period, in a case where said transfer speed is lower than an input speed of driving signal which is input to said head with said basic time period.

7. The printing method according to claim 1, wherein said step b) to said step d) are performed at least either immediately after said printing medium stars to move relative to said head or immediately before said printing medium stops moving.

8. The printing method according to claim 1, wherein said plurality of outlets are arranged all over a width of a printing area of said printing medium with respect to a direction perpendicular to said predetermined direction of movement.

9. The printing method according to claim 8, wherein said printing medium is roll paper.

10. An inkjet printing apparatus, comprising:

a head which includes a plurality of outlets and performs an operation related to ejection of droplets of ink from said plurality of outlets toward a printing medium in response to input of a driving signal based on writing data;

a moving mechanism for causing said printing medium to move relative to said head in a predetermined direction of movement;

a timing signal generator for generating an ejection timing signal each time said printing medium travels a predetermined distance relative to said head; and a driving signal generator for inputting said driving signal to said head each time said ejection timing signal is generated, wherein said driving signal generator inputs at least one non-ejection driving signal, each of which is a driving signal indicating a non-ejecting operation, to said head between driving signals respectively associated with one ejection timing signal and a next ejection timing signal generated subsequently to said one ejection timing signal in a case where an ejection interval which is a time period between generation of said one ejection timing signal and generation of said next ejection timing signal is equal to or longer than twice a basic time period of input of driving signal which is fixed for said head.

11. The printing apparatus according to claim 10, wherein the number of said at least one non-ejection driving signal is determined on the basis of a preceding ejection interval which precedes by a predetermined number of intervals to said ejection interval between said one ejection timing signal and said next ejection timing signal.

12. The printing apparatus according to claim 11, wherein a value is obtained by subtracting a predetermined extremely short time shorter than said basic time period from said preceding ejection interval, and the number of said at least one non-ejection driving signal is obtained by subtracting one from a quotient resulting from division of said value by said basic time period.

13. The printing apparatus according to claim 10, wherein said head includes piezoelectric elements.

14. The printing apparatus according to claim 10, wherein a travel speed of said printing medium relative to said head is temporarily reduced to be lower than a steady speed where said ejection timing signal is generated with said basic time period.

15. The printing apparatus according to claim 10, wherein a travel speed of said printing medium relative to said head is reduced in accordance with a transfer speed at which said writing data is transferred to said driving signal generator for generating said driving signal, to be lower than a steady speed where said ejection timing signal is generated with said basic time period, in a case where said transfer speed is lower than an input speed of driving signal which is input to said head with said basic time period.

16. The printing apparatus according to claim 10, wherein said timing signal generator generates said ejection timing signal and said driving signal generator inputs said driving signal and said at least one non-ejection driving signal in said ejection interval to said head at least either immediately after said printing medium stars to move relative to said head or immediately before said printing medium stops moving.

17. The printing apparatus according to claim 10, wherein said plurality of outlets are arranged all over a width of a printing area of said printing medium with respect to a direction perpendicular to said predetermined direction of movement.

18. The printing apparatus according to claim 17, wherein said printing medium is roll paper.

* * * * *